US009176514B2

(12) United States Patent
Huang et al.

(10) Patent No.: US 9,176,514 B2
(45) Date of Patent: Nov. 3, 2015

(54) REFERENCE VOLTAGE GENERATOR CIRCUITS AND INTEGRATED CIRCUITS HAVING THE SAME REFERENCE VOLTAGE GENERATOR CIRCUITS

(71) Applicant: iWatt Integrated Circuits Technology (Tianjin) Limited, Tianjin (CN)

(72) Inventors: Weihai Huang, Tianjin (CN); Honglai Wang, Tianjin (CN)

(73) Assignee: iWatt Integrated Circuits Technology (Tianjin) Limited, Tianjin (CN)

( * ) Notice: Subject to any disclaimer, the term of this patent is extended or adjusted under 35 U.S.C. 154(b) by 0 days.

(21) Appl. No.: 14/097,095

(22) Filed: Dec. 4, 2013

(65) Prior Publication Data

US 2014/0152289 A1 Jun. 5, 2014

(30) Foreign Application Priority Data

Dec. 5, 2012 (CN) ..... 2012 1 0518299

(51) Int. Cl.
*G05F 3/26* (2006.01)
*G05F 3/20* (2006.01)

(52) U.S. Cl.
CPC ..... *G05F 3/20* (2013.01)

(58) Field of Classification Search
CPC ..... G05F 3/26; G05F 3/30; G05F 3/262; G05F 3/265
USPC ..... 323/311–317
See application file for complete search history.

(56) References Cited

U.S. PATENT DOCUMENTS

| | | | | |
|---|---|---|---|---|
| 4,495,425 | A | 1/1985 | McKenzie | |
| 5,440,224 | A * | 8/1995 | Kimura | 323/313 |
| 5,448,174 | A * | 9/1995 | Gose et al. | 327/513 |
| 5,708,420 | A | 1/1998 | Drouot | |
| 5,774,013 | A * | 6/1998 | Groe | 327/543 |
| 8,344,720 | B2 * | 1/2013 | Nag et al. | 323/316 |

FOREIGN PATENT DOCUMENTS

| | | | |
|---|---|---|---|
| CN | 1162191 | A | 10/1997 |
| CN | 200983116 | Y | 11/2007 |
| CN | 101813960 | A | 8/2010 |
| CN | 203084596 | U | 7/2013 |
| JP | H02-145005 | A | 6/1990 |

OTHER PUBLICATIONS

State Intellectual Property Office of the People's Republic of China, First Office Action, Chinese Patent Application No. 201210518299.0, Feb. 4, 2015, twenty-two pages.

* cited by examiner

*Primary Examiner* — Adolf Berhane
*Assistant Examiner* — Yemane Mehari
(74) *Attorney, Agent, or Firm* — Fenwick & West LLP

(57) ABSTRACT

Various embodiments of the present invention relate to a reference voltage generator circuit. Specifically, the circuit may for example comprise: a mirror constant current source having a first branch and a second branch, wherein a first current on the first branch is proportional to a second current on the second branch; wherein the first branch has a first resistive element, and the second branch has two second resistive elements connected in series; and a power supply terminal located between said two second resistive elements on the second branch. A high-precision reference voltage relative to the voltage source can be provided at the power supply terminal by using the circuit provided by various embodiments of the present invention.

14 Claims, 5 Drawing Sheets

REFERENCE VOLTAGE GENERATOR CIRCUITS AND INTEGRATED CIRCUITS HAVING THE SAME REFERENCE VOLTAGE GENERATOR CIRCUITS

FIELD OF THE INVENTION

Embodiments of the present invention generally relate to the field of circuits, and more specifically to a reference voltage generator circuit.

BACKGROUND OF THE INVENTION

As semiconductor technologies develop swiftly, various integrated circuits (IC) are universally applied in industrial production and people's daily life. However in an IC (particularly, a high voltage IC), a high-accuracy reference voltage relative to a voltage source often needs to be generated. Currently, a conventional reference voltage generator circuits in the industry implements generation of the high-accuracy reference voltage via in-series resistors. However, it is very difficult to generate the high-accuracy reference voltage since a current in the circuit and a value of the resistor vary at different process corners and temperatures.

SUMMARY OF THE INVENTION

In order to address the above problems, embodiments of the present invention aim to provide a reference voltage generator circuit in the context of the specification.

According some embodiments in one aspect of the present invention, there is provided a reference voltage generator circuit which for example may comprise: a mirror constant current source having a first branch and a second branch, wherein a first current on the first branch is proportional to a second current on the second branch; wherein the first branch has a first resistive element, and the second branch has two second resistive elements connected in series; and a power supply terminal located between said two second resistive elements on the second branch.

According some embodiments in one aspect of the present invention, there is provided a reference voltage generator circuit which for example may comprise the following: wherein a proportion of the first current on the first branch to the second current on the second branch is M:N, wherein M and N are integers greater than or equal to 1.

According some embodiments in one aspect of the present invention, there is provided a reference voltage generator circuit which for example may comprise the following: wherein the first branch has a first NPN bipolar transistor thereon, the second branch has a second NPN bipolar transistor thereon, the first NPN bipolar transistor and the second NPN bipolar transistor match each other, wherein a voltage between a base and an emitter is $V_{be}$; wherein a base of the first NPN bipolar transistor is connected to a base of the second NPN bipolar transistor and connected to its own collector; an emitter of the first NPN bipolar transistor is connected to an emitter of the second NPN bipolar transistor; a collector of the first NPN bipolar transistor is connected to a high-accuracy reference voltage $V_R$ via the first resistive element; and a collector of the second NPN bipolar transistor is connected to a voltage source $V_{DDH}$ via the two second resistive elements.

According some embodiments in one aspect of the present invention, there is provided a reference voltage generator circuit which for example may comprise the following: wherein at least one of the following is included between the two second resistive elements and the voltage source $V_{DDH}$: a third NPN bipolar transistor matchable with the first NPN bipolar transistor or the second NPN bipolar transistor, wherein a voltage between a base and an emitter is $V_{be}$, its base and collector are connected to the voltage source $V_{DDH}$, its emitter is connected to the two second resistive elements; and a diode matchable with the first NPN bipolar transistor or the second NPN bipolar transistor, wherein a voltage between a positive pole and a negative pole is $V_d$, its positive pole is connected to the voltage source $V_{DDH}$, and its negative pole is connected to the two second resistive elements.

According some embodiments in one aspect of the present invention, there is provided a reference voltage generator circuit which for example may comprise the following: wherein the first branch has a first N-MOS transistor thereon, the second branch has a second N-MOS transistor thereon, and the first N-MOS transistor and the second N-MOS transistor match each other, wherein a voltage between a gate and a source is $V_{gs}$; wherein a gate of the first N-MOS transistor is connected to a gate of the second N-MOS transistor and connected to its own drain; a source of the first N-MOS transistor is connected to a source of the second N-MOS transistor; a drain of the first N-MOS transistor is connected to a high-accuracy reference voltage VR via the first resistive element; and the drain of the second N-MOS transistor is connected to a voltage source $V_{DDH}$ via the two second resistive elements.

According some embodiments in one aspect of the present invention, there is provided a reference voltage generator circuit which for example may comprise the following: wherein at least one of the following is included between the two second resistive elements and the voltage source $V_{DDH}$: a P-MOS transistor matchable with the first N-MOS transistor or the second N-MOS transistor, wherein a voltage between the gate and source is $V_{gs}$, its source is connected to the voltage source $V_{DDH}$, and its gate and drain are connected to the two second resistive elements; and a diode matchable with the first N-MOS transistor or the second N-MOS transistor, wherein a voltage between a positive pole and a negative pole is $V_d$, its positive pole is connected to the voltage source $V_{DDH}$, and its negative pole is connected to the two second resistive elements.

According some embodiments in one aspect of the present invention, there is provided a reference voltage generator circuit which for example may comprise the following: further comprising generating a desired reference voltage $V_{REF}$ relative to the voltage source $V_{DDH}$ at the power supply terminal by adjusting a ratio of the two second resistive elements on the second branch to the first resistive element on the first branch.

According some embodiments in one aspect of the present invention, there is provided a reference voltage generator circuit which for example may comprise the following: wherein the adjusting comprise: adjusting a ratio of the second resistive elements on the second branch between the voltage source $V_{DDH}$ and the reference voltage to the first resistive element on the first branch to make the ratio equal to a ratio of a difference between the $V_{DDH}$ and the $V_{REF}$ plus the $V_d/V_{be}/V_{gs}$ to a difference between the $V_R$ and $V_d/V_{be}/V_{gs}$; and adjusting a ratio of another second resistive element on the second branch to the first resistive element on the first branch to make the ratio equal to a ratio of a difference between the $V_{REF}$ and the $V_d/V_{be}/V_{gs}$ to the difference between $V_R$ and the $V_d/V_{be}/V_{gs}$.

According some embodiments in one aspect of the present invention, there is provided a reference voltage generator circuit which for example may comprise: wherein the reference voltage generator circuit is located on a substrate of the same region of an integrated circuit.

According some embodiments in one aspect of the present invention, there is provided a reference voltage generator circuit which for example may comprise: wherein the resistive elements are resistors.

According some embodiments in one aspect of the present invention, there is provided an integrated circuit which for example may comprise the reference voltage generator circuit according to the preceding text.

Exemplary solutions provided by exemplary embodiments of the present invention at least may bring about the following remarkable technical effects: a high-accuracy reference source may be obtained at the power supply terminal by allowing the mirror constant current source to generate two branches with identical current or proportional currents, and then by adjusting a ratio of resistance on the second branch to the first branch; and the high-accuracy reference voltage may be any needed or desired value. This is very important for a high-voltage IC and flexible in practical application.

BRIEF DESCRIPTION OF DRAWINGS

The above and other objects, features and advantages of exemplary embodiments of the present invention will be made more apparent by reading through detailed description with reference to figures. In the figures, several embodiments of the present invention are illustrated in an exemplary but non-restrictive manner, wherein.

In the figures, an identical or corresponding reference sign designates an identical or corresponding part.

DETAILED DESCRIPTION OF PREFERRED EMBODIMENTS

Principles and spirit of the present invention will be described with reference to several exemplary embodiments. It should be appreciated that these embodiments are presented only to enable those skilled in the art to better understand and thereby implement the present invention, not to limit the scope of the present invention in any manner.

Specific embodiments of the present invention are described below with reference to figures.

Figure 1:
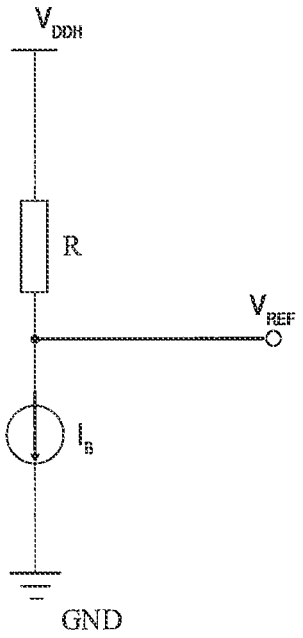
Fig. 1 (Prior Art)
FIG. 1 illustrates a reference voltage generator circuit according to the prior art.

FIG. 1 illustrates a reference voltage generator circuit according to the prior art. As shown in FIG. 1, a resistor R is connected in series in the circuit. The following may be obtained according to Ohm's law:

$$V_{DDH}-V_{REF}=I_B*R$$

Wherein $I_B$ is current, and R is a resistance. However, since a current in the circuit and a value of the resistor vary at different process corners and temperatures (namely, values of $I_B$ and R are coarse), the $V_{DDH}-V_{REF}$ generated at the power supply terminal is a low-accuracy reference voltage.

In order to eliminate an influence exerted by the current in the circuit and the value of the resistor varying at different process corners and temperatures, exemplary embodiments of the present invention provide a reference voltage generator circuit which for example may comprise: a mirror constant current source having a first branch and a second branch, wherein a first current on the first branch is proportional to a second current on the second branch; wherein the first branch has a first resistive element, and the second branch has two second resistive elements connected in series; and a power supply terminal located between said two second resistive elements on the second branch. Specifically, a proportion of the first current on the first branch to the second current on the second branch may be M:N, wherein M and N are integers greater than or equal to 1 and their values depend on a ratio of junction areas of transistors in the first branch and second branch in the mirror constant current source or an aspect ratio of a channel of an MOS transistor.

Figure 2:
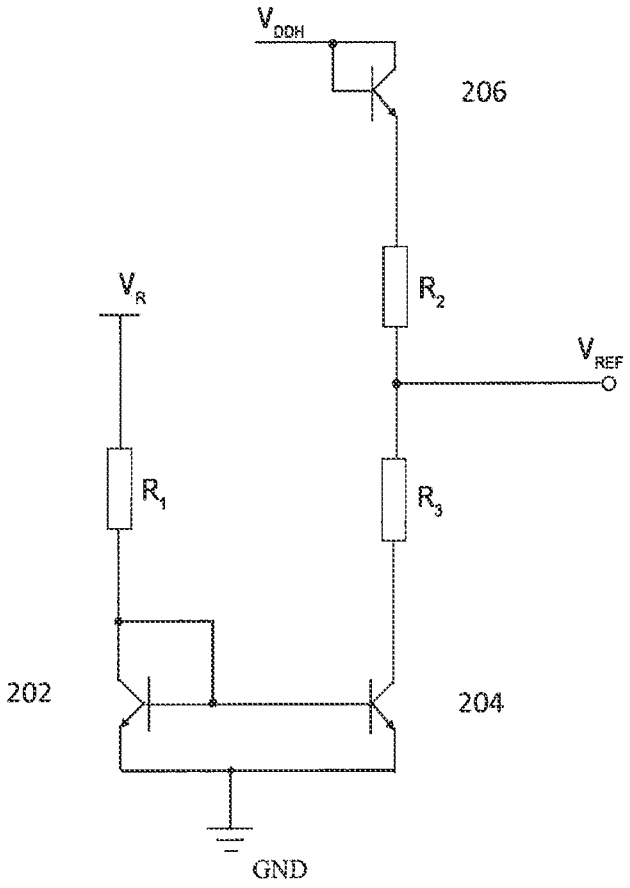
FIG. 2 illustrates a reference voltage generator circuit according to an exemplary embodiment of the present invention.

FIG. 2 illustrates a reference voltage generator circuit according to an exemplary embodiment of the present invention. In an example shown in FIG. 2, the proportion of the first current on the first branch to the second current on the second branch is 1:1(namely, the first current value is equal to the second current value). As shown in FIG. 2, the first branch has a first NPN bipolar transistor 202 thereon, the second branch has a second NPN bipolar transistor 204 thereon, the first NPN bipolar transistor 202 and the second NPN bipolar transistor 204 may match each other (e.g., identical), wherein a voltage between a base and an emitter is $V_{be}$; wherein a base of the first NPN bipolar transistor 202 may be connected to a base of the second NPN bipolar transistor 204 and connected to its own collector; an emitter of the first NPN bipolar transistor 202 may be connected to an emitter of the second NPN bipolar transistor 204; a collector of the first NPN bipolar transistor 202 may be connected to a high-accuracy reference voltage VR via the first resistive element; and a collector of the second NPN bipolar transistor may be connected to a voltage source $V_{DDH}$ via the two second resistive elements (R2 and R3).

Since the NPN bipolar transistors (204, 206) shown in FIG. 2 match one another (e.g., identical) and are located on a substrate of an identical region of an integrated circuit, $I_{R1}=I_{R2}=I_{R3}$, wherein $V_R$ is the high-accuracy reference voltage which may be offered from a Bandgap reference source or a laser trimmed low-voltage power supply.

If a voltage $V_{be}$ between the base and the emitter of the NPN bipolar transistors shown in FIG. 2 is equal, the following can be obtained:

$$(V_{DDH}-V_{REF}-V_{be})/R_2=(V_R-V_{be})/R_1;\text{ and}$$

$$(V_{REF}-V_{be})/R_3=(V_R-V_{be})/R_1$$

Therefore, $$R_2/R_1=(V_{DDH}-V_{REF}-V_{be})/(V_R-V_{be});\text{ and}$$

$$R_3/R_1=(V_{REF}-V_{be})/(V_R-V_{be})$$

For example, if $V_{be}$=0.7V, $V_{DDH}$=35V and $V_R$=5V, and the reference voltage ($V_{DDH}-V_{REF}$)=5V is expected to be obtained, the ratio of the resistive elements in the two branches may be adjusted so that $R_2/R_1$=1, and $R_3/R_1$=6.8. Additionally or alternatively, for example, if the reference voltage ($V_{DDH}-V_{REF}$)=6V is excepted to be obtained, the ratio of the resistive elements in the two branches may be adjusted so that $R_2/R_1$=1.2, and $R_3/R_1$=6.6. Preferably, in the same process flow, they are implemented in the same region of the same integrated circuit so that the values of $R_2/R_1$ and $R_3/R_1$ are less subjected to the influence of environment (e.g., voltage, process, temperature) and achieve a higher accuracy. Besides, the reference voltage $V_R$ may be offered from a Bandgap reference source or a laser trimmed low-voltage power supply, so $V^R$ has a high accuracy. Hence, the high-accuracy reference voltage may be obtained at the power supply terminal, and the high-accuracy reference voltage may be any needed or desired value. This is very important for a high-voltage IC and flexible in practical application.

Figure 3:
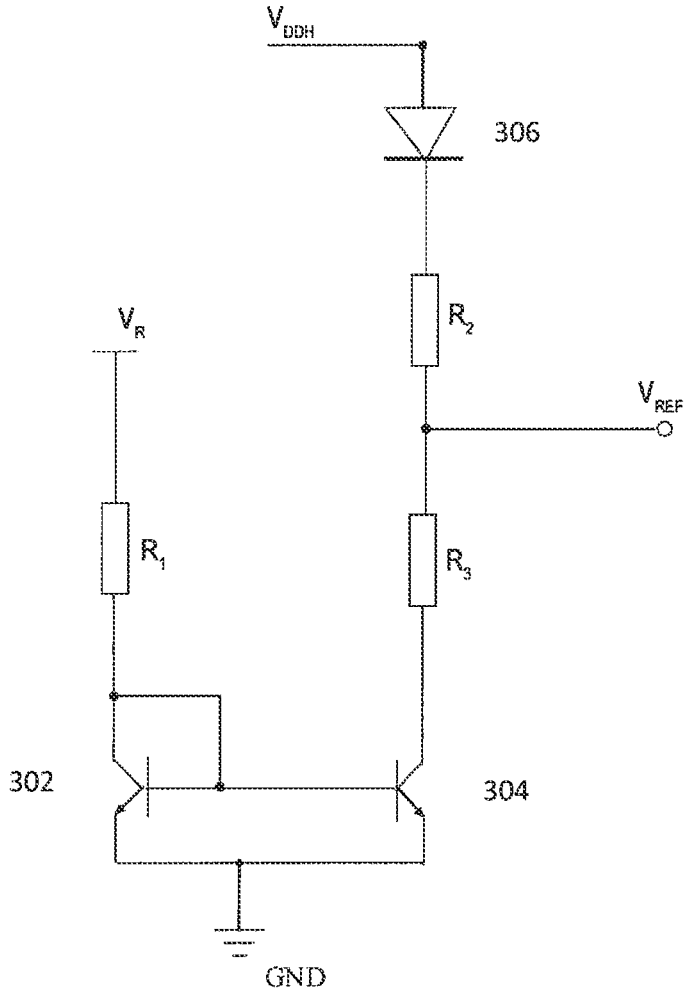
FIG. 3 illustrates another reference voltage generator circuit according to an exemplary embodiment of the present invention.

FIG. 3 illustrates another reference voltage generator circuit according to an exemplary embodiment of the present invention, wherein the proportion of the first current on the first branch to the second current on the second branch is 1:1 (namely, the first current value is equal to the second current value). Alternatively, a diode 306 may be included between $R_2$ and the voltage source $V_{DDH}$, and it is matchable with the first NPN bipolar transistor 302 or the second NPN bipolar transistor 304 shown in FIG. 2, wherein a voltage between a positive pole and a negative pole is $V_d$, its positive pole is connected to the voltage source $V_{DDH}$, and its negative pole is connected to the two second resistive elements.

A PN junction diode is provided between the base and emitter of the NPN bipolar transistor, so a voltage difference $V_{be}$ thereof is approximate to or equal to the voltage $V_d$ between the positive pole and negative pole of the diode shown in FIG. 3, and the high-accuracy reference voltage may be obtained at the power supply terminal according to the above formulas with reference to FIG. 2, and the high-accuracy reference voltage may be any needed or desired value.

Figure 4:
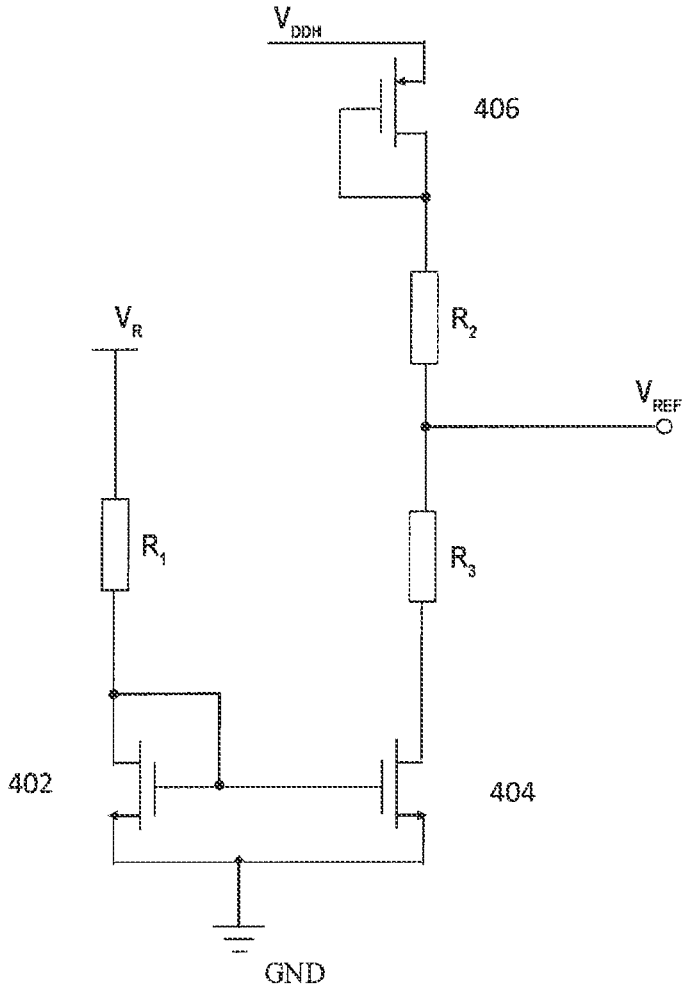
FIG. 4 illustrates a further reference voltage generator circuit according to an exemplary embodiment of the present invention.

FIG. 4 illustrates a further reference voltage generator circuit according to an exemplary embodiment of the present invention. In one example, the proportion of the first current on the first branch to the second current on the second branch is 1:1(namely, the first current value is equal to the second current value). As shown in FIG. 4, the first branch may have a first N-MOS transistor thereon 402, the second branch may have a second N-MOS transistor thereon 404, and the first N-MOS transistor 402 and the second N-MOS transistor 404 match each other, wherein a voltage between a gate and a source is $V_{gs}$; wherein a gate of the first N-MOS transistor 402 is connected to a gate of the second N-MOS transistor 404 and connected to its own drain; a source of the first N-MOS transistor 402 is connected to a source of the second N-MOS transistor 404; a drain of the first N-MOS transistor 402 is connected to a high-accuracy reference voltage $V_R$ via the first resistive element; and the drain of the second N-MOS transistor 404 is connected to a voltage source $V_{DDH}$ via the two second resistive elements.

Since the N-MOS transistor and a P-MOS transistor 406 shown in FIG. 4 match each other (e.g., identical) and are located on a substrate of an identical region of an integrated circuit, $I_{R1}=I_{R2}=I_{R3}$, wherein $V_R$ is the high-accuracy reference voltage which may be offered from a Bandgap reference source or a laser trimmed low-voltage power supply.

If a voltage $V_{gs}$ between the gate and source of the N-MOS transistor 404 and P-MOS transistor 406 shown in FIG. 4 is approximate and equal, the high-accuracy reference voltage may be obtained at the power supply terminal according to the above formulas with reference to FIG. 2, and the high-accuracy reference voltage may be any needed or desired value.

Figure 5:
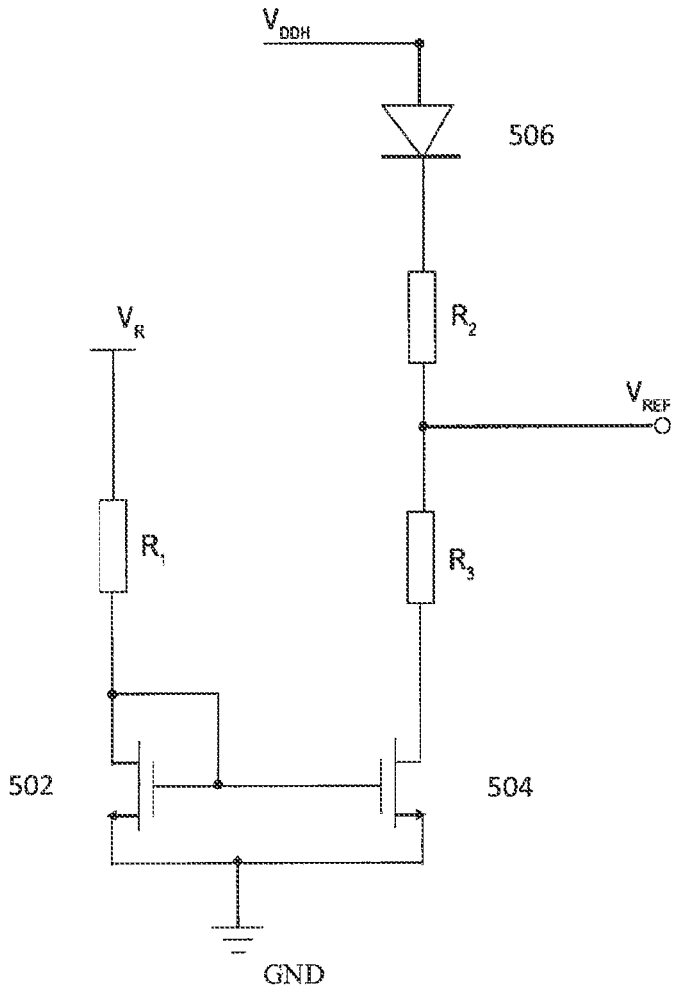
FIG. 5 illustrates a further reference voltage generator circuit according to an exemplary embodiment of the present invention.

FIG. 5 illustrates a further reference voltage generator circuit according to an exemplary embodiment of the present invention, wherein the proportion of the first current on the first branch to the second current on the second branch is 1:1(namely, the first current is equal to the second current). Alternatively, a diode 506 may be included between $R_2$ and the voltage source $V_{DDH}$, and it is matchable with the first N-MOS transistor 502 or the second N-MOS transistor 504, wherein a voltage between a positive pole and a negative pole is $V_d$, its positive pole is connected to the voltage source $V_{DDH}$, and its negative pole is connected to the two second resistive elements.

If the voltage $V_d$ between the positive pole and negative pole of the diode shown in FIG. 5 is approximate to or equal to the voltage $V_{gs}$ between the gate and source of the N-MOS transistor, the high-accuracy reference voltage may be obtained at the power supply terminal according to the above formulas with reference to FIG. 2, and the high-accuracy reference voltage may be any needed or desired value.

Embodiments of the present invention provide an integrated circuit comprising the reference voltage generator circuit stated in the preceding text.

Those skilled in the art may appreciate that the resistive elements in the exemplary embodiments of the present invention may be resistors.

It should be understood from the above depictions that modifications and variations may be made to embodiments of the present invention without departing from true spirit of the present invention. The depictions in the description are only illustrative and should not be regarded as being restrictive. Although the present invention has been depicted with reference to specific embodiments, it should be understood that the present invention is not limited to the disclosed specific embodiments. The present invention intends to cover various modifications and equivalent arrangements included in the spirit and scope of the appended claims. The scope of the appended claims meets the broadest explanations and covers all such modifications and equivalent structures and functions.

What is claimed is:

1. A reference voltage generator circuit, comprising:

a mirror constant current source having a first branch and a second branch, wherein a first current on the first branch is proportional to a second current on the second branch;

wherein the first branch has a first resistive element, and the second branch has two second resistive elements connected in series; and a power supply terminal located between said two second resistive elements on the second branch;

wherein the first branch has a first NPN bipolar transistor thereon, the second branch has a second NPN bipolar transistor thereon, the first NPN bipolar transistor and the second NPN bipolar transistor match each other, wherein a voltage between a base and an emitter is Vbe;

wherein a base of the first NPN bipolar transistor is connected to a base of the second NPN bipolar transistor and connected to its own collector;

wherein an emitter of the first NPN bipolar transistor is connected to an emitter of the second NPN bipolar transistor;

wherein a collector of the first NPN bipolar transistor is connected to a high-accuracy reference voltage VR via the first resistive element;

wherein a collector of the second NPN bipolar transistor is connected to a voltage source VDDH via the two second resistive elements;

wherein at least one of the following is included between the two second resistive elements and the voltage source VDDH:

a third NPN bipolar transistor matchable with the first NPN bipolar transistor or the second NPN bipolar transistor, wherein a voltage between a base and an emitter is Vbe, its base and collector are connected to the voltage source VDDH, its emitter is connected to the two second resistive elements; and a diode matchable with the first NPN bipolar transistor or the second NPN bipolar transistor, wherein a voltage between a positive pole and a negative pole is Vd, its positive pole is connected to the voltage source VDDH, and its negative pole is connected to the two second resistive elements.

2. The reference voltage generator circuit according to claim 1, wherein a proportion of the first current on the first branch to the second current on the second branch is M:N, wherein M and N are integers greater than or equal to 1.

3. The reference voltage generator circuit according to claim 1, wherein a ratio may be adjusted of the two second resistive elements on the second branch to the first resistive element on the first branch in order to generate a desired reference voltage VREF relative to the voltage source VDDH at the power supply terminal.

4. The reference voltage generator circuit according to claim 3, wherein a ratio is adjusted of one of the second resistive elements on the second branch between the voltage source VDDH and the reference voltage to the first resistive element on the first branch to be equal to a ratio of the VDDH minus the VREF minus the Vd or the Vbe to the VR minus the Vd or the Vbe; and a ratio is adjusted of another of the second resistive elements on the second branch to the first resistive element on the first branch to be equal to a ratio of the VREF minus the Vd or the Vbe to the VR minus the Vd or the Vbe.

5. The reference voltage generator circuit according to claim 1, wherein the reference voltage generator circuit is located on a substrate of the same region of an integrated circuit.

6. The reference voltage generator circuit according to claim 1, wherein the resistive elements are resistors.

7. An integrated circuit, comprising the reference voltage generator circuit according to one of claims 1, 2, and 3 to 6.

8. A reference voltage generator circuit, comprising:

a mirror constant current source having a first branch and a second branch, wherein a first current on the first branch is proportional to a second current on the second branch;

wherein the first branch has a first resistive element, and the second branch has two second resistive elements connected in series; and a power supply terminal located between said two second resistive elements on the second branch;

wherein the first branch has a first N-MOS transistor thereon, the second branch has a second N-MOS transistor thereon, and the first N-MOS transistor and the second N-MOS transistor match each other, wherein a voltage between a gate and a source is Vgs;

wherein a gate of the first N-MOS transistor is connected to a gate of the second N-MOS transistor and connected to its own drain;

wherein a source of the first N-MOS transistor is connected to a source of the second N-MOS transistor;

wherein a drain of the first N-MOS transistor is connected to a high-accuracy reference voltage VR via the first resistive element;

wherein a drain of the second N-MOS transistor is connected to a voltage source VDDH via the two second resistive elements;

wherein at least one of the following is included between the two second resistive elements and the voltage source VDDH:

a P-MOS transistor matchable with the first N-MOS transistor or the second N-MOS transistor, wherein a voltage between the gate and source is Vgs, its source is connected to the voltage source VDDH, and its gate and drain are connected to the two second resistive elements; and a diode matchable with the first N-MOS transistor or the second N-MOS transistor, wherein a voltage between a positive pole and a negative pole is Vd, its positive pole is connected to the voltage source VDDH, and its negative pole is connected to the two second resistive elements.

9. The reference voltage generator circuit according to claim 8, wherein a proportion of the first current on the first branch to the second current on the second branch is M:N, wherein M and N are integers greater than or equal to 1.

10. The reference voltage generator circuit according to claim 8, wherein a ratio may be adjusted of the two second resistive elements on the second branch to the first resistive element on the first branch in order to generate a desired reference voltage VREF relative to the voltage source VDDH at the power supply terminal.

11. The reference voltage generator circuit according to claim 10, wherein a ratio is adjusted of one of the second resistive elements on the second branch between the voltage source VDDH and the reference voltage to the first resistive element on the first branch to be equal to a ratio of the VDDH minus the VREF minus the Vd or the Vgs to the VR minus the Vd or the Vgs; and a ratio is adjusted of another of the second resistive elements on the second branch to the first resistive element on the first branch to be equal to a ratio of the VREF minus the Vd or the Vgs to the VR minus the Vd or the Vgs.

12. The reference voltage generator circuit according to claim 8, wherein the reference voltage generator circuit is located on a substrate of the same region of an integrated circuit.

13. The reference voltage generator circuit according to claim 8, wherein the resistive elements are resistors.

14. An integrated circuit, comprising the reference voltage generator circuit according to one of claims 8 and 9-13.

* * * * *